US011759926B2

(12) United States Patent
Friberg

(10) Patent No.: US 11,759,926 B2
(45) Date of Patent: Sep. 19, 2023

(54) OIL LEVEL WARNING AT HYDRAULIC IMPULSE WRENCHES

(71) Applicant: ATLAS COPCO INDUSTRIAL TECHNIQUE AB, Stockholm (SE)

(72) Inventor: John Robert Christian Friberg, Nacka (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 649 days.

(21) Appl. No.: 16/614,294

(22) PCT Filed: May 4, 2018

(86) PCT No.: PCT/EP2018/061466

§ 371 (c)(1),
(2) Date: Nov. 15, 2019

(87) PCT Pub. No.: WO2018/210585

PCT Pub. Date: Nov. 22, 2018

(65) Prior Publication Data

US 2021/0154809 A1 May 27, 2021

(30) Foreign Application Priority Data

May 16, 2017 (SE) ..... 1730134-2

(51) Int. Cl.
*B25B 21/02* (2006.01)
*B25B 23/145* (2006.01)
*G08B 21/18* (2006.01)

(52) U.S. Cl.
CPC ..... *B25B 21/02* (2013.01); *G08B 21/187* (2013.01); *B25B 23/1453* (2013.01)

(58) Field of Classification Search
CPC ..... B25B 21/02; B25B 23/1453
See application file for complete search history.

(56) References Cited

U.S. PATENT DOCUMENTS 6,110,045 A * 8/2000 Schoeps ..... B25B 21/02 464/25
6,167,606 B1 1/2001 Mueller et al.
(Continued)

FOREIGN PATENT DOCUMENTS

| | | |
|---|---|---|
| DE | 19503524 A1 | 8/1996 |
| EP | 0773854 A1 | 5/1997 |
| EP | 2291266 A1 | 3/2011 |

OTHER PUBLICATIONS

International Search Report (ISR) and Written Opinion dated Aug. 14, 2018 issued in International Application No. PCT/EP2018/061466.

*Primary Examiner* — Curtis A Kuntz
(74) *Attorney, Agent, or Firm* — Holtz, Holtz & Volek PC

(57) ABSTRACT

A method and a device for detecting the oil level in a hydraulic pulse unit at an impulse type power wrench, wherein the pulse unit comprises an oil filled pulse chamber, a motor driven inertia drive member, and a kinetic energy receiving member connected to an output shaft and intermittently coupled to the inertia drive member via an oil cushion to receive kinetic energy from the inertia drive member during repeated energy transfer phases. The rotation speed of the inertia drive member is measured both at the start of a pulse generating phase and at the end of that phase, wherein the two measured speeds are compared to each other, and when the speed at the end of the pulse generating phase exceeds the speed at the end of that phase by a certain percentage a faulty signal is emitted indicating a too low oil level in the pulse unit.

4 Claims, 1 Drawing Sheet

(56) References Cited

U.S. PATENT DOCUMENTS

| | | | | |
|---|---|---|---|---|
| 8,338,997 | B2 * | 12/2012 | Nishikawa | B25F 5/006 310/58 |
| 8,640,789 | B2 | 2/2014 | Harada et al. | |
| 8,905,154 | B2 * | 12/2014 | Uemura | B25B 23/1453 173/200 |
| 2002/0035876 | A1 * | 3/2002 | Donaldson, Jr. | B25B 23/1456 73/862.21 |
| 2011/0203822 | A1 * | 8/2011 | Harada | B25B 21/02 173/20 |
| 2011/0214894 | A1 * | 9/2011 | Harada | B25B 21/02 173/2 |
| 2013/0056237 | A1 * | 3/2013 | Soderlund | B25B 21/02 173/218 |
| 2016/0195422 | A1 | 7/2016 | Nelson et al. | |
| 2016/0375570 | A1 * | 12/2016 | Boeck | G05B 19/4062 700/169 |

* cited by examiner

OIL LEVEL WARNING AT HYDRAULIC IMPULSE WRENCHES

The invention relates to a method and a system for detecting and emitting a warning signal in case of a declined efficiency of an impulse type power wrench, in particular wherein the efficient problem is due to a too low oil level in the hydraulic pulse unit.

A problem concerned with power wrenches of the above type is that the output pulse energy of the hydraulic pulse unit is very much dependent on the oil level therein, which means for instance that a too low oil level in the pulse unit would result in a decreased energy of the delivered torque pulses. This in turn would result in an unacceptable result at tightening of a screw joint.

The above problem is due to an inevitable leakage of oil, whatever small, both during use of the wrench and at storage thereof, and over some time the oil level in the pulse unit will become decreased to an unacceptably low level causing an impaired operation order and/or a lowered output pulse energy.

Therefore, it is an object of the invention not to overcome oil leakage, which would be almost impossible, but to provide a method and a system for detecting and emitting a warning signal as an unacceptably low oil level has occurred in the hydraulic pulse unit of an impulse type power wrench.

For explaining the background of the invention it is essential to know the mechanical structure and operational features of a hydraulic pulse unit. The mechanical parts of the pulse unit is a kinetic energy delivering inertia drive member connected to the motor of the tool, and an energy receiving member connected to the output shaft of the wrench. Both pulse unit members operate in a chamber filled with oil, wherein the kinetic energy obtained by acceleration of the inertia drive member is transferred to the receiving member via at least one oil cushion entrapped between the two members. A high pressure transient is momentarily built up in the oil cushion to transfer the kinetic energy of the inertia drive member.

Accordingly, the invention is based on the circumstance that during a pulse generating sequence the inertia drive member is accelerated during a full revolution to obtain a certain speed and a certain kinetic energy, whereupon it is abruptly stopped by hitting the receiving member via an entrapped oil cushion, thereby delivering its kinetic energy to the receiving member and the output shaft. At the transfer of the kinetic energy the rotation speed of the inertia drive member is abruptly brought down to almost stand still. In some cases the inertia drive member may even re-bounce for a slight reverse movement. This means that the pulse unit operates normally and that all the kinetic energy of the inertia drive member is transferred to the receiving member. It also means that the pulse unit has a correct oil level.

It has been noticed though that when the oil level in the pulse unit has become too low the operation order of the pulse unit is somewhat changed such that during the energy transfer between the inertia drive member and the receiving member the rotational speed of the inertia drive member is not brought down to such a low speed or even re-bounce as would be expected for a correct and satisfactory energy transfer. Instead, it has been noted that the inertia drive member passes the energy transfer phase at some residual speed, which means that the inertia drive member has not been able to deliver all its kinetic energy to the receiving member. Accordingly, an efficient enough oil cushion has not been created between the inertia drive member and the energy receiving member. This results in that the overall efficiency of the pulse unit is decreased. In almost every case this impaired energy transfer is due to a too low oil level in the pulse chamber.

It is an object of the invention to provide a method and a system for detecting such a deteriorated energy transfer due to low oil level and to emit a warning signal to alert the operator that the power wrench does not deliver an acceptable output pulse energy and should be taken out of production for service attention.

Further objects and advantages of the invention will appear from the following specification and claims.

The invention is illustrated in the accompanying drawing in which

As described above the invention relates to a method and a device for detecting and warning for a too low oil level and a resulting efficiency loss in a hydraulic pulse unit at impulse type power wrenches. Some oil leakage from this type of wrenches is inevitable and you always have to calculate with a declined oil level over time. The object of invention is to detect such an oil loss at an early stage to get a premature information of a decreasing efficiency of the pulse unit and the level of urgency of service need for the tool. If the pulse unit efficiency is deteriorated to a certain level due to a decreased oil level the output power of the impulse wrench will be too low to perform an acceptable working result, i.e. performing an acceptable pre-tensioning result of a screw joint being tightened.

Figure 1:
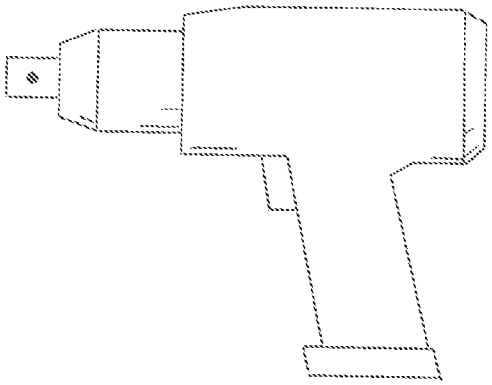
FIG. 1 shows one type of impulse wrenches on which the invention is applicable.

An impulse wrench on which the invention is applicable is illustrated in FIG. 1 and comprises a hydraulic pulse unit with an inertia drive member connected to the wrench motor and an energy receiving member connected to an output shaft. Both members operate in an oil filled chamber and arranged to entrap between them a certain oil volume during a pulse generating phase. During operation the drive member is accelerated by the motor for almost a full revolution thereby gathering kinetic energy, whereafter the oil volume is entrapped and forms an energy transferring oil cushion. The kinetic energy is transferred by the oil cushion under a high pressure during the pulse generating phase. During this operation phase the entire kinetic energy of the drive member is normally transferred to the receiving member and, hence, to the output shaft, which means that the drive member will come to a complete standstill or even being caused to rebound before it can be started on another acceleration phase to build up kinetic for a next-coming pulse generating phase.

If, however, the oil level in the hydraulic chamber becomes too low, leaving space for air, there may be some air mixed with the oil in the entrapped oil cushion, which means that the oil cushion will be somewhat elastic and resilient. This means in turn that the pressure in the oil cushion will not reach a desired peak level and that the energy transfer between the two members is impaired. It also means that the drive member could pass through the energy transferring phase without being brought to a full stop and without delivering all of its kinetic energy to the receiving member and output shaft.

Figure 2:
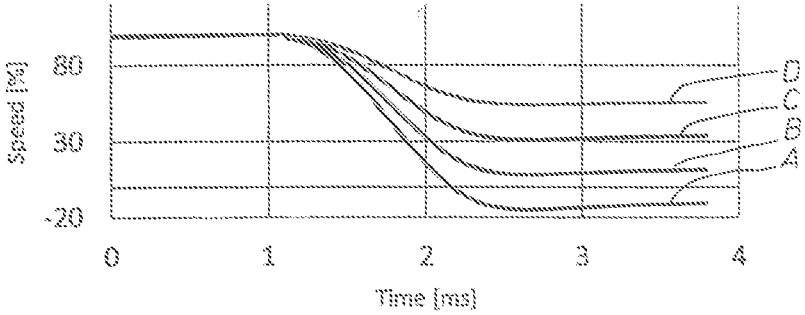
FIG. 2 shows a graph illustrating the residual speed of the inertia drive member during a pulse generating phase at different oil levels in the pulse unit.

In FIG. 2 four different curves illustrate the speed of the inertia drive member during pulse generation phases in four different oil level situations. The speed is shown as a percentage of the drive member speed at the beginning of the pulse generating phase, which is 100%. The curves illustrate the speed of the inertia drive member per millisecond (ms). Curve A illustrates a normal pulse generation with a correct oil level in the pulse unit. The energy transferring pulse follows a correct and approved pattern which indicates a normal retardation of the inertia drive member and that the kinetic energy is transferred to the receiving member by an unaffected oil cushion. The drive member is not only brought to a full stop at the end of the pulse but is caused to rebound as illustrated by the speed curve A extends below the zero line.

Also in a pulse generating phase wherein no rebounding takes place, as illustrated by curve B, a normal and approved energy transfer is accomplished. In this case the drive member is brought to an almost full stop which is indicated in that the curve B runs close to the zero line. This indicates that the oil cushion is unaffected and that the entire kinetic energy of the drive member is transferred to the receiving member.

On the other hand, the curves C and D shown in the graph of FIG. 2 illustrate two different energy transferring phases which are not approved. The reason is that the drive member has a residual rotation speed at the end of the generated pulse of about 30% (C) and 50% (D) of the speed at the beginning of the pulse which indicates that the kinetic energy of the drive member has not been satisfactory transferred to the receiving member. This relatively high residual speed at the end of the energy transferring phase indicates that the oil level in the pulse unit has become too low and that the performance of the impulse wrench is impaired.

Accordingly, by studying and analyzing the speed pattern of the inertia drive member during the energy transferring phase it is possible to detect an inclined oil level in the pulse unit.

Figure 3:
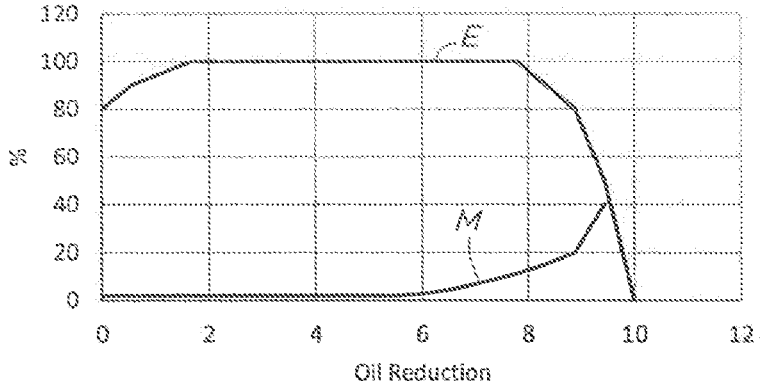
FIG. 3 shows a graph illustrating the relationship between the loss of oil in the pulse unit and the output power of an impulse wrench.

In FIG. 3 there is illustrated how the performance of the impulse wrench varies with oil level. The upper curve E illustrates how the performance of the wrench differs by a percentage of the performance of a correct and approved pulse, indicated at 100%. The curve E is related to the number of pulses shown on the horizontal line.

The curve M in FIG. 3 illustrates a percentage of a number of disqualified energy transferring phases due to affected oil cushions, and when the percentage of disqualified pulses exceeds a certain magnitude the performance of the pulse unit starts to decline. In practice, individual pulses may occasionally indicate an impaired energy transfer without a too low oil level really exists, and to be able to roll out such occasional insignificant indications a larger number of pulses has to be studied and analyzed. The pulse unit performance is not affected by individual occasional post-pulse speed variations.

The invention provides a method to detect and warn for an impaired pulse wrench performance due to a declined oil level in the pulse unit just by studying and analyzing the residual speed of drive member at the end of the energy transferring phase. The proportion of the speed detected at the end of the energy transferring phase compared to the speed detected at the beginning of the energy transferring phase indicates the influence of the oil level on the pulse unit generation efficiency. The result indicates the urgency of the service need for the pulse unit, and a warning signal could be generated to alert the operator that the pulse unit efficiency has deteriorated to such a level where the wrench should be taken out of production.

It is to be noted that the invention is not limited to the above described example but could be varied within the scope of the claims. For instance, the above described impulse wrench comprises an pulse unit having a drive- and pulse receiving member arranged to entrap a single oil cushion, but the invention is intended to be applied also on pulse units having more than one oil cushion.

The invention claimed is:

1. A method for detecting an oil level in a hydraulic pulse unit of an impulse type power wrench, wherein the pulse unit comprises an oil filled pulse chamber, a motor driven inertia drive member, and a kinetic energy receiving member connected to an output shaft and intermittently coupled to the inertia drive member via at least one oil cushion to receive kinetic energy from the inertia drive member during repeated energy transfer phases, the method comprising:

measuring a rotation speed of the inertia drive member at a very beginning of each energy transfer phase;

measuring the rotation speed of the inertia drive member at an end of each energy transfer phase;

comparing the rotation speed of the inertia drive member measured at the end of each energy transfer phase with the rotation speed of the inertia drive member measured at the very beginning of each energy transfer phase; and emitting a fault signal indicating that the measured rotation speed at the end of each energy transfer phase is higher than a certain percentage of the measured rotation speed at the very beginning of each energy transfer phase.

2. The method according to claim 1, further comprising emitting a warning signal when fault signals are emitted at a certain proportion of a number of generated pulses.

3. The method according to claim 2, wherein said certain proportion has two or more different levels to initiate warning signals of different levels of urgency as to a condition of the pulse unit.

4. The method according to claim 3, wherein said two or more levels comprise a lower proportion level for indicating a reduced efficiency of the pulse unit, and a higher proportion level for indicating an immediate service need for the pulse unit.

* * * * *